US005674052A

United States Patent [19]

Berra

[11] Patent Number: 5,674,052

[45] Date of Patent: Oct. 7, 1997

[54] PINCH PUMP HAVING SELECTABLE PRESSURE PLATE SIZES AND A FLEXIBLE TUBE WITH ATTACHMENT RIBS

[75] Inventor: Humberto A. Berra, Hialeah, Fla.

[73] Assignee: Coulter International Corp., Miami, Fla.

[21] Appl. No.: 555,687

[22] Filed: Nov. 14, 1995

[51] Int. Cl.[6] ..... F04B 43/00; F04B 43/10

[52] U.S. Cl. ..... 417/53; 417/479; 604/153

[58] Field of Search ..... 417/478, 479, 417/480, 53; 604/153

[56] References Cited

U.S. PATENT DOCUMENTS 4,653,719 3/1987 Cabrera et al. ..... 251/7

*Primary Examiner*—Roland McAndrews
*Attorney, Agent, or Firm*—Warren W. Kurz

[57] ABSTRACT

Pumping apparatus for dispensing or otherwise metering precise and minute volumes (measured in microliters) of fluid (e.g. human blood) from a flexible conduit containing such fluid. According to a preferred embodiment, such apparatus includes a pinch valve for selectively captivating a certain volume of fluid in the conduit between the pinch valve and the conduit's outlet end, and a pinch pump for selectively expelling a predetermined portion of the captivated fluid through the conduit's outlet end. The pinch pump is located and adapted to pinch closed a predetermined length of the conduit's fluid passageway. Preferably, such length is adjustable to adjust the volume of fluid dispensed or metered, and the pinch pump is structured to assure that, during activation of the pinch pump, the captivated fluid is advanced towards the outlet end of the conduit.

13 Claims, 4 Drawing Sheets

PINCH PUMP HAVING SELECTABLE PRESSURE PLATE SIZES AND A FLEXIBLE TUBE WITH ATTACHMENT RIBS

CROSS REFERENCE TO RELATED APPLICATIONS

Reference is made to the following commonly assigned, concurrently filed application, the contents of which being incorporated herein by reference: (1) U.S. application Ser. No. 08/557,226, entitled "Improved Apparatus and Method for Automated Production of Blood Smear Slides"; and (2) U.S. application Ser. No. 08/557,229, entitled "Blood Analysis System Having Blood Storage, Transport and Automatic Slide-Making Capabilities".

BACKGROUND OF THE INVENTION

1. Field of the Invention

The present invention relates to improvements in apparatus for dispensing or metering minute volumes of fluid, in particular blood and other biological fluids, with high precision and repeatability in biological fluid-handling systems. The invention also relates to a method for dispensing or metering precise volumes of liquid from a flexible, liquid-filled conduit using a relatively simple liquid-dispensing apparatus.

2. Description of the Prior Art

Positive displacement and syringe-type pumps are commonly employed in hematology and other biological fluid-handling systems for delivering or dispensing very small amounts/volumes of biological fluid (e.g. blood) from a supply source to a use area. While being capable of precise volume control, such devices tend to be somewhat complex in construction and, hence, relatively costly to manufacture. Further, most commonly used positive displacement and syringe-type pumps require that there be a break in the fluid conduit to the pump in order to introduce the liquid into the pump. This leads to potential leakage and contamination problems which, obviously, cannot be tolerated in hematology/blood testing equipment.

Also part of the prior art are fluid-control devices known as "pinch" valves. Such devices are often used with flexible conduits to control the direction of fluid flow. Typical of such valves is the "make/before break" pinch valve disclosed in the commonly assigned U.S. Pat. No. 4,653,719. Such a valve comprises a slidably movable pressure-applying piston which cooperates with an anvil to pinch closed the longitudinal fluid passageway in the flexible conduit. This particular pinch valve is adapted for use with a fluid conduit having a pair of longitudinal ribs which extend radially outward from the conduit's cylindrical wall, on diametrically opposite sides thereof. Each of the ribs has a T-shaped transverse cross-section and is adapted to be grasped by suitable structure on the piston and its cooperating anvil, whereby the fluid passageway in the conduit can be forcibly opened to permit fluid flow following periods in which the passageway has been pinched closed.

SUMMARY OF THE INVENTION

In view of the foregoing discussion concerning the problems associated with displacement and syringe-type pumps, an object of this invention is to provide a simple, yet highly reliable, apparatus for dispensing and/or metering precise and minute volumes (microliters) of fluid from a fluid-containing flexible conduit containing such fluid.

According to one aspect of the invention, a fluid-dispensing apparatus generally comprises pinch-pumping means located along a fluid-filled flexible conduit for selectively pinching closed a predetermined length of the conduit in order to expel from the conduit's outlet end a precise volume of fluid defined by the length of the conduit's fluid passageway which has been pinched closed and the cross-sectional area of the fluid passageway. Preferably, the pinch-pumping means operates in combination with a pinch valve which, when operated, assures that the fluid displaced by the pinch pump does not travel backwards towards the fluid source. Also preferred is that the pinch-pumping means includes means for selectively adjusting the length of the passageway closed by the pinch-pumping means in order to adjust the volume of fluid dispensed. Further preferred is that the pinch-pump means includes structure for assuring that, during closure of the passageway, the fluid is expelled in the direction of the conduit's fluid-dispensing end, rather than towards the fluid source. Also preferred is that the pinch-pumping means is adapted to grip the conduit so that the fluid passageway can be physically opened following a period in which it has been pinched closed.

According to another aspect of the invention, a plurality of pinch pumps are arranged side-by-side and sequentially actuated to sequentially dispense precise volumes of fluid.

The invention will be better understood from the ensuing detailed description of preferred embodiments, reference being made to the accompanying drawings wherein like reference characters denote like parts.

DETAILED DESCRIPTION OF PREFERRED EMBODIMENTS

Figure 1:
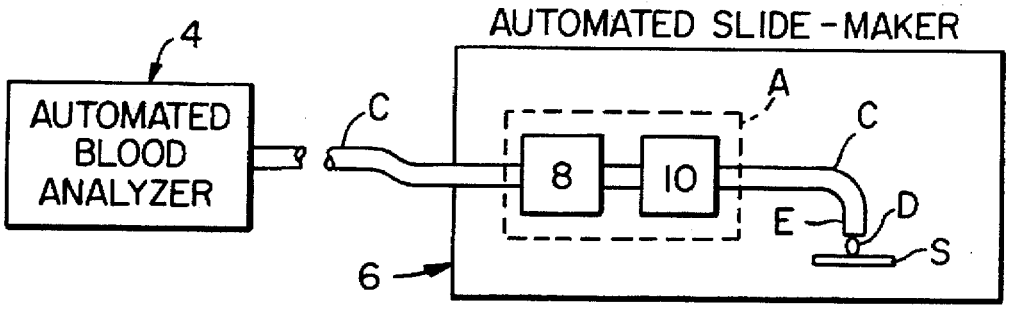
FIG. 1 is a schematic illustration of a blood analyzing system embodying the present invention.

Referring now to the drawings, FIG. 1 schematically illustrates an automated blood analyzer 4 which is coupled to an automated slide maker 6 via a flexible fluid conduit C. The blood analyzer 4 may, for example, be the COULTER® STKS Blood Analyzer which is adapted to automatically perform a series of tests on a blood sample provided from a vial of blood. In certain cases where it is desirable to further analyze the blood sample under a microscope, it is necessary to produce a microscope slide which bears a monolayer of the blood sample. In such case, a predetermined volume of the blood sample, perhaps 200 microliters, is transported from the blood analyzer through the fluid conduit C to the automated slide maker. Suitable apparatus for transporting a blood sample between the blood analyzer and the slide maker is disclosed in the aforementioned and concurrently filed U.S. application Ser. No. 08/557,229, entitled "Blood Analysis System Having Blood Storage, Transport and Slide-Making Capabilities".

As best described in the aforementioned U.S. application, Ser. No. 08/557,226, entitled "Improved Apparatus and Method for Automated Production of Blood Smear Slides", slide maker 6 operates to dispense a drop D of blood received through conduit C onto a glass slide S, whereupon the drop is automatically spread on the slide to produce a blood smear. Upon being dried and stained, the blood smear can be subsequently examined and analyzed through a microscope. Essential to the consistent production of high quality blood smears is that a precise volume of blood, in this case, about 4 microliters in volume, be deposited on each glass slide prior to spreading. The fluid dispensing apparatus of the invention is capable of providing this essential detail.

Figure 2:
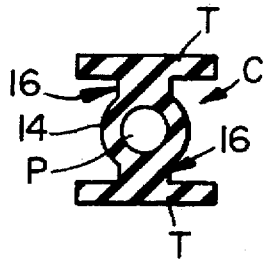
FIG. 2 is a cross-sectional illustration of a preferred fluid conduit with which the invention is particularly useful.

According to a preferred embodiment, the fluid dispensing apparatus A of the invention comprises the combination of a conventional pinch valve 8 and a pinch pump 10 both being disposed adjacent a portion of the flexible conduit which, at least between the pinch valve and the conduit's fluid-dispensing end E, is filled with blood. Preferably, the fluid conduit is of the type shown in cross-section in FIG. 2, comprising a generally cylindrical section 14 defining a fluid passageway P, and a pair of longitudinally extending ribs 16. Typically, the cylindrical section has a circular cross-section and an inside diameter of about 0.023 inch. Each of the ribs 16 extends radially outward from section 14 (about 0.1 inch) and terminates in a tabular portion T, thereby giving the rib a generally T-shaped cross-section. Preferably, the conduit is made of a supple and resilient material, e.g. silicone rubber, so that the fluid passageway can be readily pinched closed by applying relatively small forces to the conduit's exterior walls. As explained below, the tabular portions of ribs 16 cooperate with internal structure associated with the pinch valve and pinch pump to facilitate opening of the conduit's fluid passageway P after such passageway has been pinched closed by these components, whereby any tendency for the conduit to remain closed after a pinching force has been removed can be overcome by pulling the respective tabs 16 apart. Having the ability to force the tubing open with the T-shaped sections ensures restoring the original circular cross section, which helps the repeatability of the output volume.

As shown in FIG. 1, the pinch valve and pinch pump components are arranged with respect to the fluid conduit so that the pinch pump component is located between the pinch valve and the fluid dispensing end E of the conduit. Preferably, the construction of the pinch valve 8 is identical to that disclosed in the aforementioned U.S. Pat. No. 4,653,719, and the disclosure of this patent is incorporated herein by reference.

Figure 3:
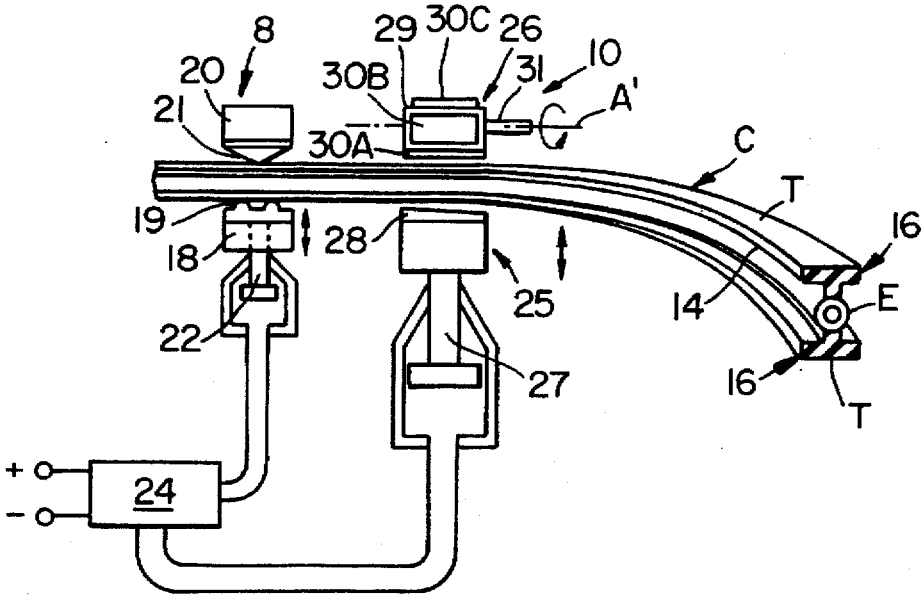
FIG. 3 is a diagrammatic representation of a preferred embodiment of the invention.

Referring to FIG. 3, pinch valve 8 generally includes a slidably movable piston 18 having a T-shaped channel (not shown) formed in a conduit-engaging surface 19 thereof for receiving the tabular portion T of the conduit's T-shaped rib. The pinch valve further includes a stationary anvil member 20 which cooperates with piston 18 to pinch closed the conduit's fluid passageway P and thereby captivate fluid in the conduit's passageway between the pinch valve and the fluid-dispensing end E of the conduit. The conduit-engaging surface 21 of the anvil member is also provided with a channel of T-shaped cross section for receiving the tabular portion T of the conduit. As indicated in FIG. 3, both conduit-engaging surfaces of cooperating members 18 and 20 may be contoured so as to pinch closed a relatively short length of the conduit, typically only 1–2 millimeters. As schematically shown, the plunger member is moved by a pneumatic actuator 22 operated by DC pneumatic pump valve 24. Thus, as the plunger member is moved toward the conduit, surfaces 19 and 21 cooperate to collapse the conduit wall, thereby closing the fluid passageway in the tubing. When plunger 18 is moved in the opposite direction, the conduit's fluid passageway is forcibly opened due to the engagement of the T-shaped rib in the T-shaped channels formed in surfaces 19 and 21.

Pinch pump 10 basically comprises a slidably mounted piston member 25 which moves (as indicated by the arrow) relative to a stationary anvil member 26 for the purpose of pinching closed a predetermined length of conduit C in order to expel a desired volume of fluid from the fluid-dispensing end of the conduit. The vertical position of piston member 25 is controlled by a pneumatic actuator 27 which, in turn, is controlled by the electrically operated valve 24. The conduit-engaging surfaces of the pinch pump are relatively long compared to the conduit-engaging surfaces 19 and 21 of the pinch valve. The anvil member 26 is in the form of a rotatably mounted spindle 29 which supports four, conduit-engaging members 30A–30D of different lengths. Spindle 29 is supported for rotation about axis A' and is manually rotatable by a knurled shaft 31 to present different members 30A–30D into a position adjacent the conduit and into a cooperating position with respect to plunger surface 28 so that different volumes of fluid can be expelled from the conduit's fluid-dispensing end. Preferred structural details of the pinch pump component are shown in FIGS. 4–6.

Figure 4:
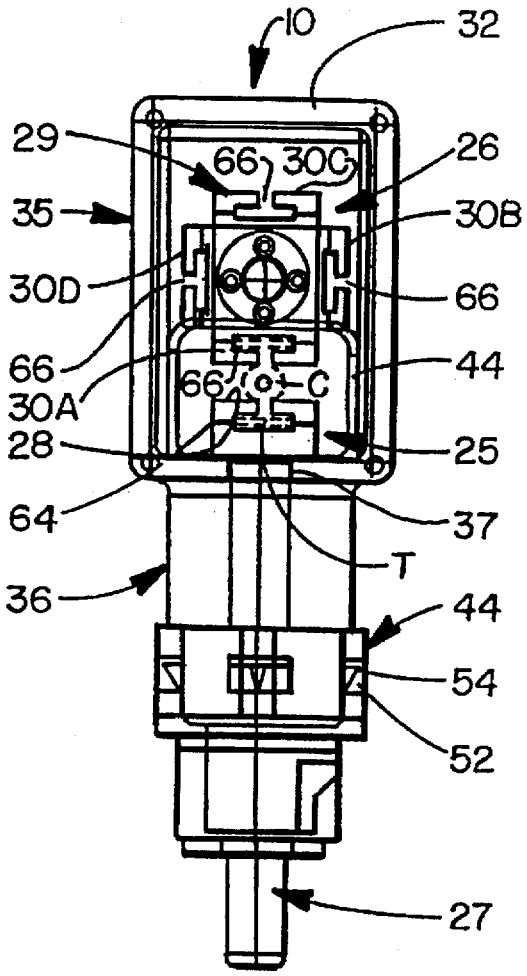
FIGS. 4 and 5 are front and side elevations of a preferred pinch pump assembly.
Figure 5:
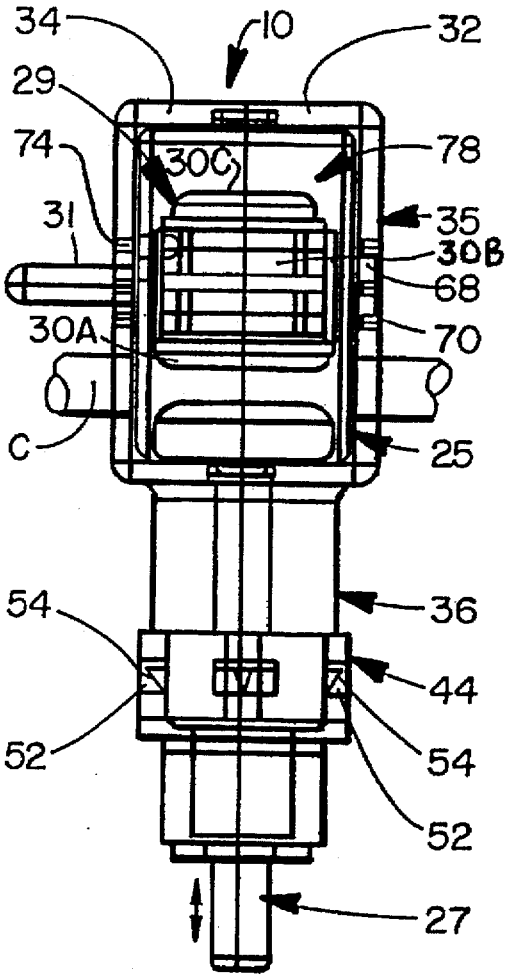
Figure 6:
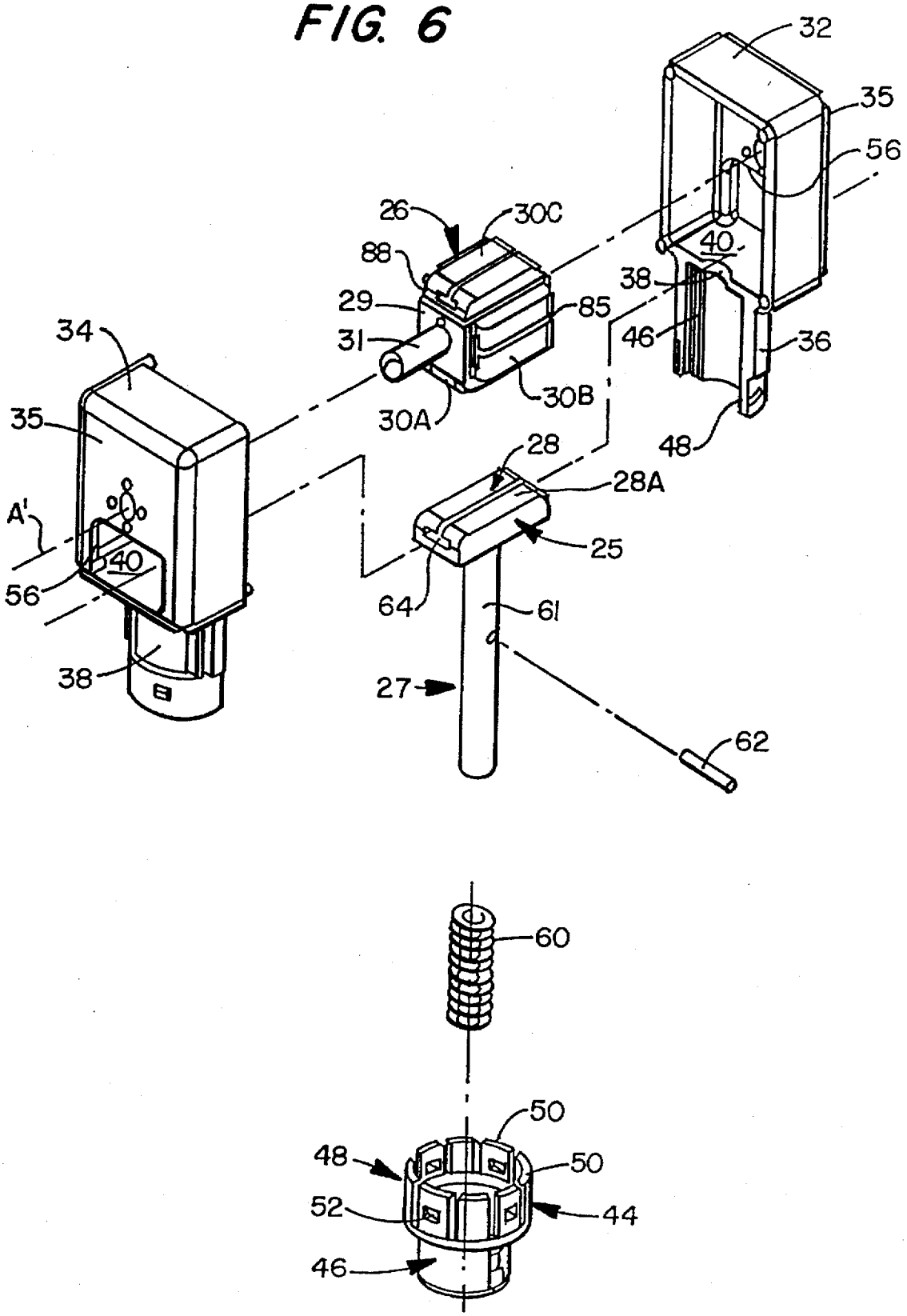
FIG. 6 is an exploded perspective view of the pinch pump assembly shown in FIGS. 3 and 4.

Referring to FIGS. 4–6, pinch pump 10 comprises a housing or body formed as an assembly of two substantially identical half shells 32 and 34, made of molded plastic or similar material. When assembled together, the half shells define a housing having a rectangular, box-like upper portion 35, and a cylindrically-shaped lower portion 36. The respective interiors of the upper and lower portions communicate through a circular opening 37 defined by a pair of cooperating, semi-circular notches 38 formed in an interior wall 40 of each of the half shells 32, 34. The two half shells 32 and 34 of the pinch pump housing are held together by a two step collar/mount 44 having a threaded lower portion 46 and an enlarged castellated or notched portion 48 having a plurality of upstanding flexible tabs 50. Alternate ones of tabs 50 have individual apertures 52 for mating, snap-fit engagement with a plurality of individual wedge shaped projections 54 integral with the cylindrical lower portion 36 of the pinch-pump housing. When the housing is assembled, projections 54 seat within the apertures 52 holding the two half shells 32 and 34 tightly together.

The box-like upper portion 35 of the pinch pump housing is provided with a rectangular access opening 56 for receiving conduit C. The aforementioned piston 25 is slidably mounted in the pinch-pump housing and comprises an elongated actuator 27 having a rod 61 which is slidably mounted within opening 37 formed in the housing's interior wall 40. The piston actuator is normally biased downward (as viewed in the drawings) owing to the force of a helical coil spring 60 encircling rod 61 of the piston actuator. A cross pin 62 passes through rod 61 and provides a seat for one end of the spring. The opposite end of the spring is captivated by the bottom surface of housing wall 40. The cross pin slides along opposing grooves (not shown) formed in the opposing interior surfaces of housing shells 32 and 34, thereby preventing the piston from rotating about its axis of movement. Piston 25 is provided with a conduit-engaging member 28 having a planar surface 28A with a channel 64 of T-shaped cross-section formed therein. Such channel, which is adapted to receive the tabular portion T of conduit rib 16.

Figure 7:
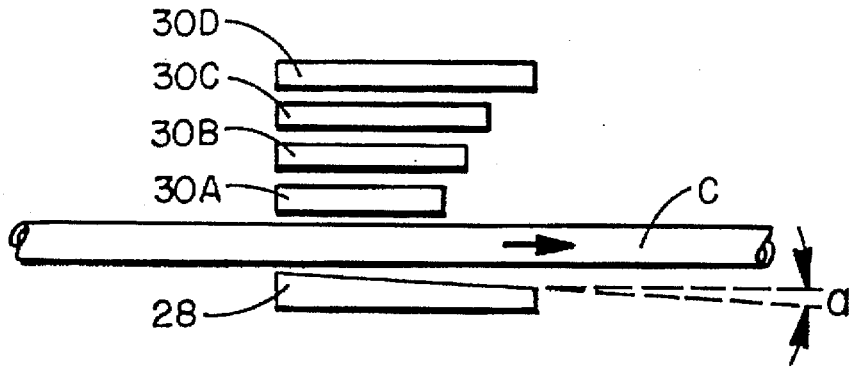
FIG. 7 illustrates pump structure for varying the pump output and for controlling the direction of fluid flow; and, FIG. 8 is a diagrammatic representation of another preferred embodiment of the invention.

As noted above, anvil member 26 comprises a spindle 29 which is rotatably mounted in the upper portion of the pinch-pump housing for movement about axis A'. The spindle supports four conduit-engaging members 30A, 30B, 30C and 30D, each being disposed at 90° intervals about the exterior of the spindle. As schematically illustrated in FIG. 7, each of the conduit-engaging members 30A–30D has a planar surface of different length, whereby each is adapted to expel different volumes of fluid from the conduit when cooperating with the opposing surface of piston member 28. As shown, the planar surface of member 28 is inclined at an angle a relative to the plane of the conduit-engaging surfaces of members 30A–30D. This assures that the fluid is forced to move in the direction of the arrow in FIG. 7. Obviously, if desired, each of the members 30A–30D could be provided with a suitably inclined surface, in which case the conduit-engaging surface of member 28 could be flat, i.e. non-inclined. Preferably, the length of member 28 is about 21 mm, and the respective lengths of members 30A–30D range from 15 mm to 21 mm, whereby the volume of drop D can be either maintained substantially constant as the cross-sectional area of the conduit varies, or the drop volume can be adjusted for conduits of constant cross-sectional area. Each of the four conduit-engaging surfaces has a channel 66 for receiving the conduit tab T formed therein of T-shaped cross-section. Preferably, members 28 and 30A–30D are made of a relatively non-compliant plastic, such as acetal homopolymer.

Referring to FIG. 5, a support boss 68 projects from one end of the spindle 29 and is receivable within an aperture 70 in half shell 32 (FIG. 4). The opposite end of spindle 29 has a knurled handling shaft 31 extending through an aperture 74 in the opposite half shell 34. With the two half-shells 32 and 34 assembled together, the T-slot 64 integral with the piston surface 28 is aligned with one of the T-slots 66 of the spindle. Rotation of the spindle 29 permits the operator/assembler to select the length of members 30A–30D to accommodate a selected conduit diameter.

Figure 8:
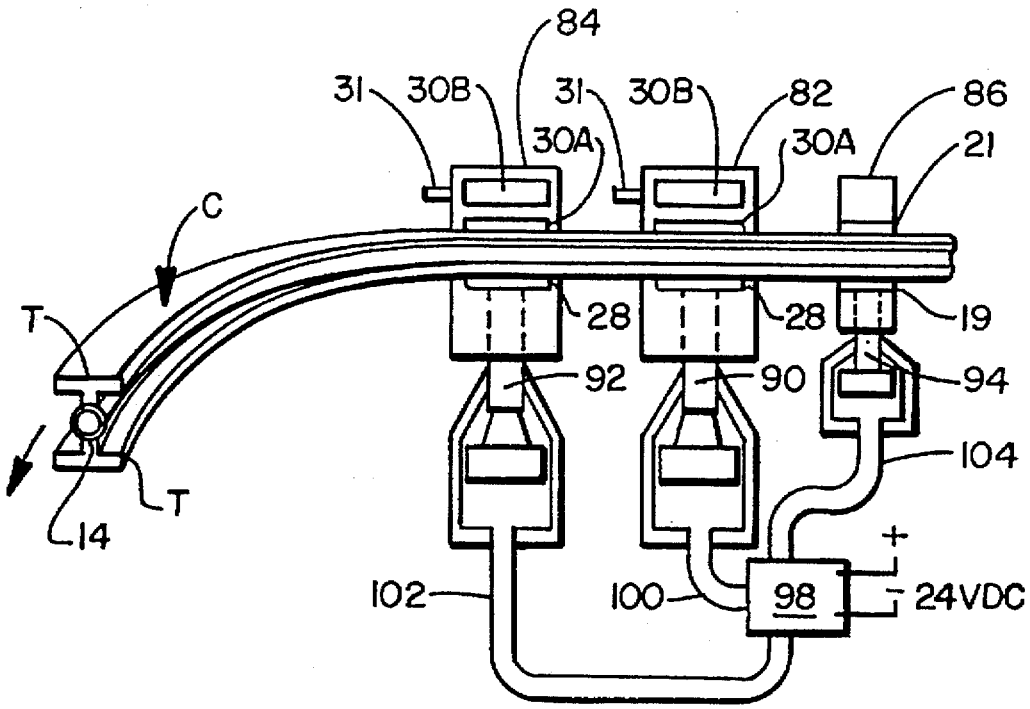

In the diagrammatic representation of FIG. 8, two substantially identical pinch pumps 82 and 84 may be operably associated with a pinch valve 86 to dispense two drops of fluid, one after the other. As shown, the flexible I-beam conduit C is first passed into and through the pinch valve 86, and thence through the pinch pumps 82 and 84. Individual pneumatic actuators 90, 92 and 94 are secured onto each piston of the pinch pumps 82 and 84 and pinch valve 86. A pneumatic or electric solenoid actuated pneumatic pump 98 forces air under pressure (30 psi), as called for, via lines 100, 102 and 104, to respective pneumatic actuators 90, 92 and 94.

In operation, on command, from software control, fluid (blood) is first forced into and through the conduit C from the host apparatus (not shown) through the pinch valve 86 and the pinch pumps 82 and 84, to the fluid-dispensing end E of the conduit. The pinch valve is then closed, dead ending the conduit from the pinch valve 86 back to the host apparatus. Excess fluid is dripped into a waste receptacle (not shown). At a command from the software control, the solenoid actuator 90 is energized, pinching the conduit within the pinch pump 82 and expelling the desired/selected volume of fluid from the conduit end. Before opening pinch pump 82, solenoid actuator 92 is energized, thereby dispensing a second drop of fluid. Thereafter, deenergization of the actuators 90, 92 and 94 withdraws the respective pistons and opens the conduit for reception of the next fluid input.

It should be understood that in its simplest form, the present invention contemplates the use of a single pinch pump with a single pinch valve. However, for purposes of its contemplated present use, the invention is described with reference to the use of two pinch pumps and a single pinch valve to ensure delivery of two samples from a single volume of liquid. Of course, should it be necessary or required by the demands of the biomedical community, the arrangement of pinch pumps and pinch valves can be infinite with multiple tree/branch configuration of pinch pumps and pinch valves. The present invention can be employed in any structural combination wherein there is a requirement for repeatably metering extremely accurate and precise volumes of fluid.

I claim:

1. Apparatus for dispensing a precise quantity of fluid from a fluid-filled flexible conduit having fluid inlet and outlet ends and an interconnecting fluid passageway of predetermined cross-sectional area, said apparatus comprising:

a) closure means for selectively closing said passageway at a first position spaced from said outlet end;

b) first pinch pump means for selectively closing a predetermined length of said passageway at a second position between said first position and said outlet end, the closure of said predetermined length of said passageway being effective to expel said precise quantity of fluid from said outlet end, said precise quantity being substantially defined by the product of said predetermined length and said cross-sectional area:

c) means for selectively operating said closure means and said first pinch pump means, and;

d) means for selectively adjusting the length of the passageway closed by the pinch-pumping means in order to adjust the volume of the fluid dispensed.

2. The apparatus as defined by claim 1 wherein said closure means comprises a pinch valve.

3. The apparatus as defined by claim 10 further comprising additional pinch pump means for selectively closing a predetermined length of said fluid passageway, said additional pinch pump means being located between said first pinch pump means and said outlet end, and means for operating said pinch pump means, one at a time and in sequence, starting with said first pump means and moving towards said outlet end, each pinch pump, upon being operated to effect closure of the fluid passageway, remaining effective to close the fluid passageway while the remaining pinch pumps are operated, whereby multiple, discrete volumes of fluid are sequentially dispensed from said outlet end.

4. In a biological fluid-handling system, apparatus for dispensing a precise volume of a biological fluid from an open-ended, biological fluid-filled, flexible conduit having a longitudinally extending fluid passageway, said apparatus comprising a pinch pump adapted to engage said conduit and selectively pinch closed a predetermined length of said passageway in order to expel said precise volume of biological fluid from the open end of said conduit, said pinch pump comprising: (i) a pump housing for receiving a length of said conduit; (ii) an anvil member mounted on said housing at a first location adjacent to the biological fluid-filled conduit received by said housing; (iii) a piston member mounted on said housing at a second location adjacent to said received conduit and opposite said anvil member, said piston member being movable between a first position in which said piston member cooperates with said anvil member to pinch closed said predetermined length of the conduit's fluid passageway, and a second position in which said piston and anvil members are sufficiently spaced apart to allow fluid flow through said passageway of the received conduit; and (iv) drive means for selectively moving said piston member between its first and second positions; said anvil member comprising a spindle member rotatably mounted and manually rotatable on said housing about an axis perpendicular to the direction of movement of said piston member, said spindle member having a plurality of elongated and substantially planar surfaces extending in the direction of said axis, each of said spindle surfaces being adapted to cooperate with a surface of said piston member to pinch closed said fluid passageway, each of said plurality of elongated and planar surfaces being of a different length measured along the longitudinal axis of said fluid passageway, whereby different lengths of fluid passageway are pinched closed, depending on the rotational position of said spindle.

5. The apparatus as defined by claim 1 wherein said flexible conduit comprises a pair of longitudinal ribs extending outwardly from opposite sides thereof, and wherein each of said planar surfaces of said spindle member and said surface of said piston member define structure for engaging said ribs.

6. The apparatus as defined by claim 1 wherein the number of said elongated and substantially planar surfaces of said spindle member is four.

7. The apparatus as defined by claim 4 wherein said anvil and piston members have conduit engaging surfaces which cooperate to advance the fluid in said passageway in a desired direction as said piston member is moved towards its first position.

8. The apparatus as defined by claim 7 wherein said plunger surface and a cooperating, conduit-closing surface of said anvil are angularly disposed with respect to each other to advance fluid in said passageway in a desired direction as said piston member is moved towards its first position.

9. The apparatus as defined by claim 4 wherein said anvil and piston members comprise means for physically grasping opposite sides of said conduit to physically open said fluid passageway as said piston member is moved from its first position to its second position.

10. The apparatus as defined by claim 9 wherein said flexible conduit has a pair of longitudinal ribs extending outwardly from opposite sides thereof, and wherein said anvil and piston members comprise means for physically engaging said ribs.

11. The apparatus as defined by claim 10 wherein each of said ribs has a substantially T-shaped transverse cross-section, and wherein each of said anvil and piston members defines a channel of substantially T-shaped cross-section for receiving a portion of said ribs.

12. A method of delivering a precise quantity of fluid from a fluid supply to a fluid receiving apparatus comprising the steps of:

providing a predetermined length of tubing having an inlet and an outlet, and a fluid passageway therebetween;

filling the tubing with a fluid to be dispensed therefrom in a precise metered amount;

selectively adjusting the length of the passageway closed by the pinch-pump in order to adjust the volume of fluid dispensed;

clamping the tubing closed at a first position; and clamping the tubing closed at a second position intermediate said first position and said outlet to expel a desired amount of fluid through said outlet.

13. A method of delivering precise, discrete, volumes of fluid from a fluid supply to a fluid receiving apparatus comprising the steps of:

providing a length of flexible tubing having an inlet and an outlet and a fluid passageway therebetween;

filling the tubing with a fluid to be dispensed therefrom in precise, discrete, volumes;

selectively adjusting the length of the passageway closed by the pinch-pump in order to adjust the volume of fluid dispense;

clamping said fluid passageway closed at a first location;

pinching said tubing at a second location to close said passageway at a second location intermediate said first location and said outlet end, said outlet, thereby expelling a first volume of fluid from said outlet; and, pinching said tubing closed at said third location subsequent to pinching said tubing closed at said second location to expel a second predetermined quantity of fluid from said outlet end.

* * * * *